United States Patent [19]

Silverman

[11] Patent Number: 5,074,560

[45] Date of Patent: Dec. 24, 1991

[54] PERMUTATION GROUP GAMES

[76] Inventor: Jack Silverman, 302 W. 87th St., New York, N.Y. 10024

[21] Appl. No.: 584,552

[22] Filed: Sep. 18, 1990

Related U.S. Application Data

[63] Continuation-in-part of Ser. No. 327,076, Sep. 18, 1990, Pat. No. 4,957,298.

[51] Int. Cl.[5] ..... A63F 9/04

[52] U.S. Cl. ..... 273/146; 273/93 R

[58] Field of Search ..... 273/146, 93 R

[56] References Cited

U.S. PATENT DOCUMENTS 3,608,906 9/1971 Odier ..... 273/146

FOREIGN PATENT DOCUMENTS 2421650 12/1979 France ..... 273/146

*Primary Examiner*—Benjamin Layno

*Attorney, Agent, or Firm*—Pennie & Edmonds

[57] ABSTRACT

A game is described involving operations on a six-sided cube. Each of the six sides of the cube has four corners which are identified by a different symbol; and the order of the symbols on each of the six sides of the cube is rotationally distinct. The cube has eight vertices each formed by three corners of three different sides. The symbols may be ordered in two ways: the same symbol may be found at each of the three corners that form a vertex, or the same symbol may be found at adjacent vertices on opposite side of a common edge. The object of the game is for the player to begin with a first orientation of the cube which defines a first sequence of symbols and to obtain a second sequence of symbols by performing a series of manipulations on the six sided cube. Preferably the game is played as a baseball game with two players alternating turns and with scoring of runs, hits and outs depending on the number of cube rotations required to turn the cube to match the second sequence.

17 Claims, 2 Drawing Sheets

PERMUTATION GROUP GAMES

CROSS-REFERENCE TO RELATED APPLICATION

This is a continuation-in-part of application Ser. No. 327,076 which issued as U.S. Pat. No. 4,957,298 on Sept. 18, 1990.

BACKGROUND OF THE INVENTION

The present invention relates to permutation groups and games utilizing such groups.

If one defines a set of elements X and an operation * that assigns to each pair of elements a and b of X an element c of X, then the pair G=(X,*) is called a group if it has the properties of closure, associativity, identity and inverse. For the pair (X,*) to have closure, the operation * must assign to each pair of elements of X another element of X. Thus, if a, b are elements of X, then *(a,b) (which may also be written a*b) must also be an element of X. For the pair (X,*) to have associativity, then a*(b*c)=(a*b)*c where a, b, c are elements of X. For the pair (X,*) to have an identity, there must be an element I in X such that I*x=x*I=x for each element x of the set X. For the pair (X,*) to have an inverse, then each element x in the set X must have an element $x^{-1}$ in the set X for which $x*x^{-1}=x^{-1}*x=I$ where I is the identity element.

An example of a group is the pair formed by the positive real numbers and the operation of multiplication. Multiplication of two positive real numbers has closure since it always yields a positive real number. Multiplication is associative; the identity element is 1; and the inverse of any positive real number "a" under the operation of multiplication is 1/a. Another example of a group is the pair formed by the real numbers and the operation of addition.

A permutation of a set of elements is an ordering of the set of elements. For example, if the set of elements consists of the four members, 1,2,3 and 4, one such ordering is 1234 and another such ordering is 2143. The number of different orderings of a set of elements is equal to n!, where n is the number of different elements in the set. For example, if the set of elements consists of the four numbers 1,2,3,4, then there are $4!=4\times3\times2\times1=24$ different ways of arranging these numbers. These 24 different ways are set forth in Table I.

TABLE I

| | | | |
|---|---|---|---|
| 1234 | 2134 | 3124 | 4123 |
| 1243 | 2143 | 3142 | 4132 |
| 1324 | 2314 | 3214 | 4213 |
| 1342 | 2341 | 3241 | 4231 |
| 1423 | 2413 | 3412 | 4312 |
| 1432 | 2431 | 3421 | 4321 |

While there are 24 different ways of arranging four numbers, if we regard each set of numbers as "wrapping around" such that the fourth number is next to the first number then the 24 different patterns each of which has four different starting points Thus we may say that there are only six rotationally distinct ways of arranging the four numbers. For example, for the set "1,2,3,4" of column 1, there appears a rotational equivalent in columns 2,3 and 4, namely "2,3,4,1", "3,4,1,2", and "4,1,2,3". Similarly, for the set "1,2,4,3" in column 1, there appears a rotational equivalent in columns 2,3, and 4, namely "2,4,3,1", "3,1,2,4", and "4,3,1,2", and so on.

As is demonstrated below, operations can be defined on the collection of all permutations of a set of elements such that the pair formed by the collection and the operation(s) satisfies the properties of closure, associativity, identity and inverse. Such pairs are called permutation groups. For further information about permutation groups, see Fred S. Roberts, *Applied Combinatories*, (Prentice-Hall, 1984), especially §7.2.

In the teaching of the rules of permutation groups to beginning students and others having trouble mastering the concepts and principles of same, it is important for teachers to present the material in an effective manner. Traditional methods of teaching such as memorization of modular systems and derivation of equations has in many instances been very difficult for both the student and the teacher. It is therefore desirable to have an apparatus and a method for teaching and learning the rules of permutation groups which is less tedious than the traditional methods and which provides for the student a rewarding experience.

Equally important are the avid game players who are always looking for new and challenging games which may be played for sheer intellectual stimulation and pleasure. It is therefore desirable to have an apparatus and a method for playing a game which has varying degrees of difficulty and which provides exciting entertainment to the avid game player.

SUMMARY OF THE INVENTION

This invention provides a novel approach to teaching and learning of the properties of permutation groups.

It is an object of the present invention to provide teachers with an interesting approach to teaching the properties of permutation groups to students.

It is another object of the present invention to provide students with a challenging and enjoyable approach to learning the properties of permutation groups.

Another object of the present invention is to provide students with an apparatus and method of playing a game which will facilitate the learning process involved in mastering the rules of permutation groups.

A further object of the present invention is to provide an apparatus and method of playing a game which provides measurable success for both the student and the teacher of permutation group rules.

Still a further object of the present invention is to provide an apparatus and method of playing a game for entertainment and pleasure purposes.

Yet another object of the present invention is to provide an apparatus and method of playing a game which is easy to learn, yet provides sufficient complexity to appeal to a broad range of persons.

It is an object of the present invention to provide a game wherein the method of play may be altered slightly to provide additional complexity as the players acquire expertise.

In accordance with a preferred embodiment of the invention, a baseball game is disclosed which uses a six-sided cube on each side of which has been marked one of the six rotationally distinct arrangements of a set of four elements with each element being marked in one of the four corners of the side. To play the game, one player specifies a first sequence of the four elements and obtains a second sequence by rolling the cube. The second player then attempts to change the second sequence to the first sequence by performing a series of manipulations on the cube.

For example, in a baseball game, one player acting as the pitcher chooses one of the twenty four different orderings by specifying a cube face and an orientation. The player then rolls the cube, so that a new sequence appears on a specified face of the cube when it lands. The object of the game is for the second player to start with the sequence that appears on the top of the cube when rolled and bring the cube to the sequence that was first chosen by the first player. If this is accomplished in 3 moves, for example, the second player has made a single; if this is accomplished in 2 moves, the second player has made a double; if the player achieves this in 1 move, it equals a home run; and if this is accomplished in 4 moves, this equals a sacrificed fly (or walk, if no man is on base). If the player cannot bring the cube to the sequence chosen by the pitches in 4 moves, then the player is out. The game continues for nine innings as in a conventional baseball game; with the players alternating their roles, and the player wins the game who has scored the most number of runs at the end of the ninth inning.

In an alternate embodiment of the present invention a computer displays two different four-digit sequences randomly, and the object is for the player to make the first sequence match the second sequence by providing the computer with a minimum of commands which the computer uses to perform a series of transformations on the digits of the second sequence Illustratively, these transformations can be the same transformations as those performed when rotating a cube.

BRIEF DESCRIPTION OF THE DRAWINGS

These and other objects, features and advantages of the present invention will become apparent from the following detailed description of the invention when considered in conjunction with the accompanying drawings.

DETAILED DESCRIPTION OF THE PRESENT INVENTION

Figure 1:
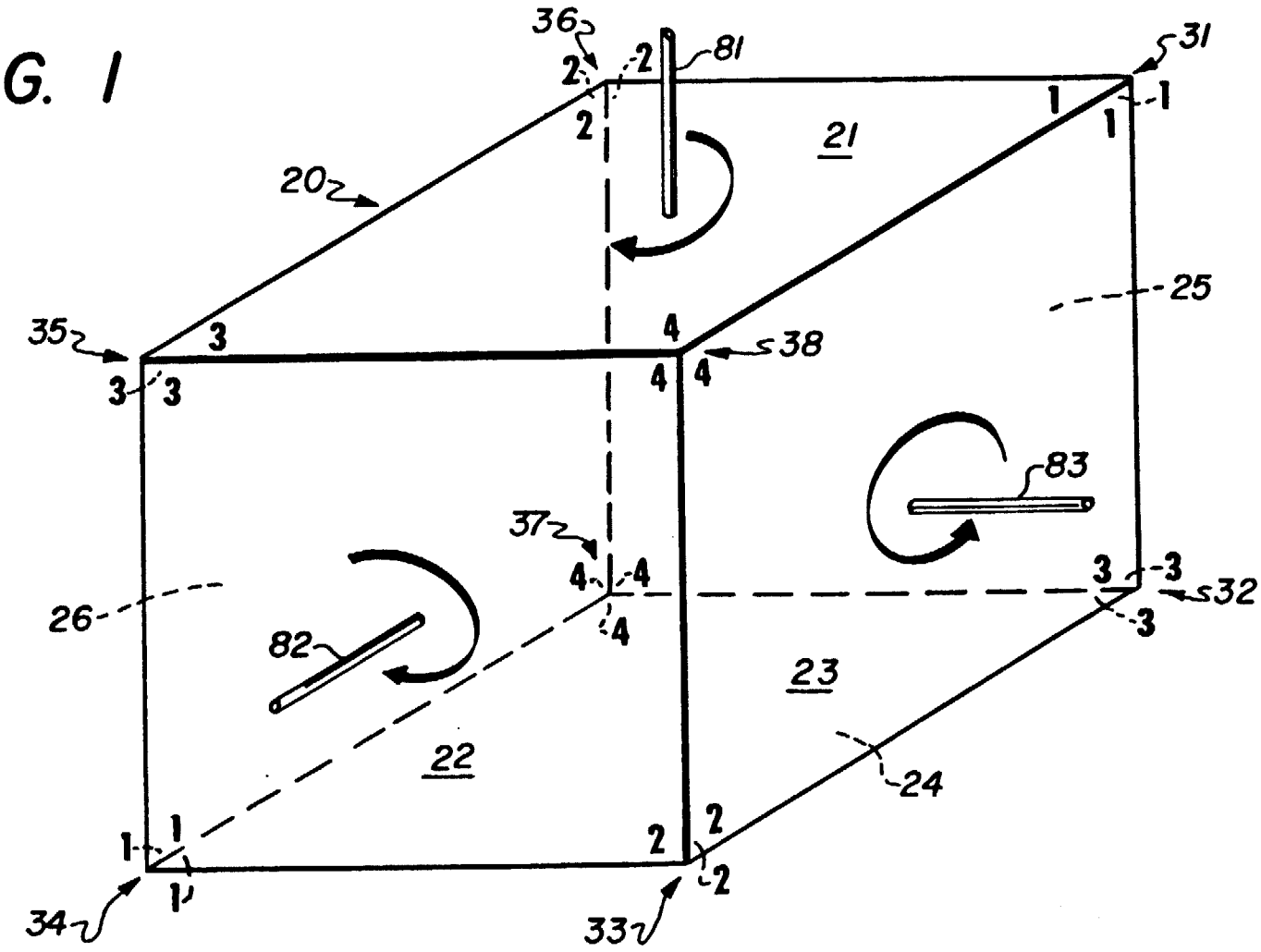
FIG. 1 is a perspective view of a first cube useful in practicing the present invention.
Figure 2:
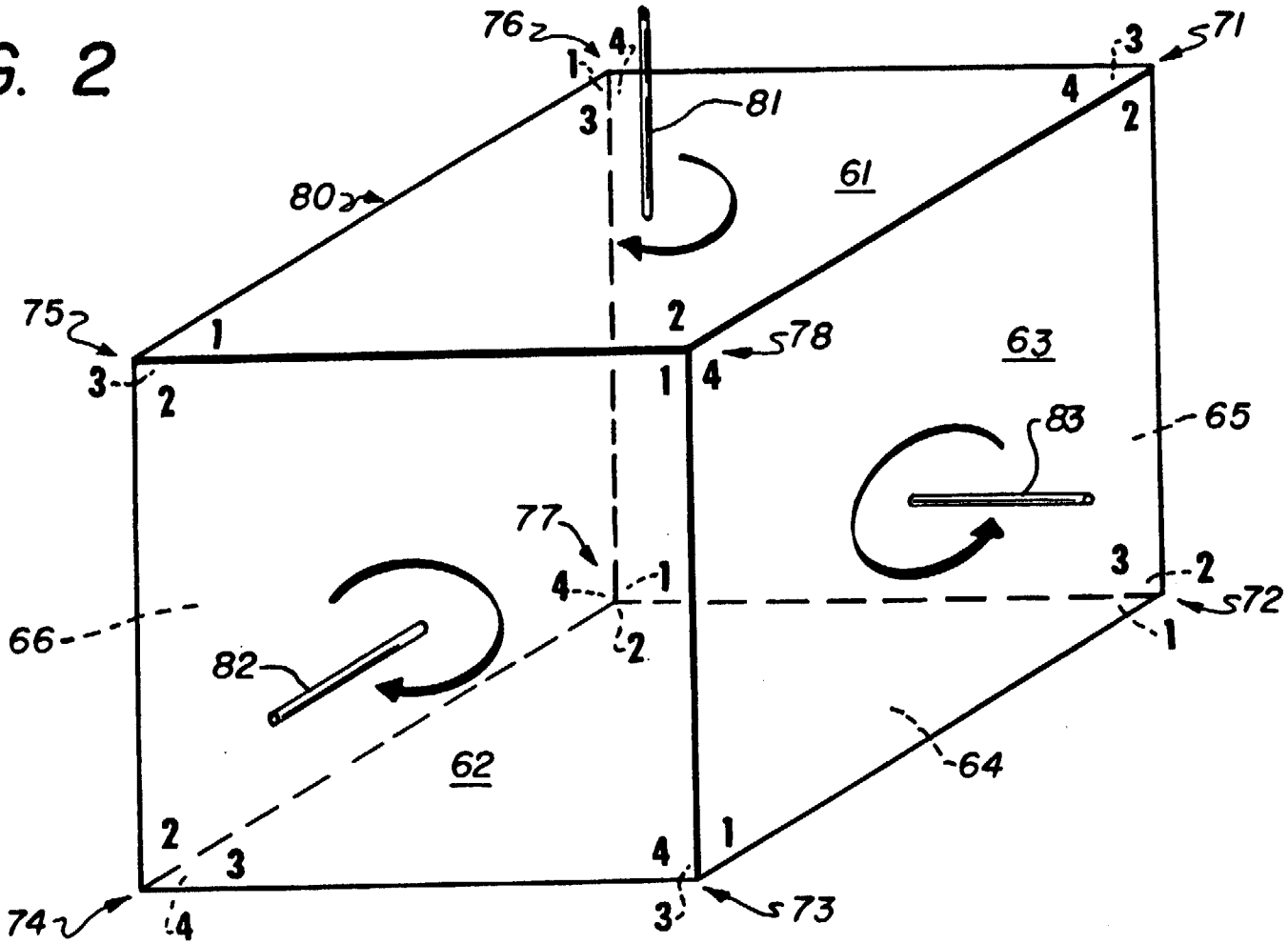
FIG. 2 is a perspective view of a second cube useful in practicing another embodiment of the present invention.

In a preferred embodiment of the present invention, cubes 20 or 60 shown in FIGS. 1 and 2 are used.

Cube 20 comprises six faces 21-26, each face having four corners. There are eight vertices 31-38, at each of which three corners of three different faces meet; and there are twelve edges, each edge joining two adjacent vertices. The four corners of each face are numbered 1, 2, 3 and 4 respectively, and the order of these numbers on each face is different and rotationally distinct. Nevertheless, the number at the three corners that form each vertex is the same. For this arrangement, diametrically opposite corners of the cube have the same number. Thus, there are two vertices 31, 34 at which the corners are all numbered 1, and these vertices are diametrically opposite each other. Similarly, there are two vertices 33, 36 at which the corners are all numbered 2, and these vertices are diametrically opposite each other, etc.

Since each of the numbers 1, 2, 3, 4 is found on each face in a different rotationally distinct order, twenty-four different sets of numbers can be specified by specifying both a face of cube 20 and the starting point for the numbers on that face. These twenty-four sets of numbers are the twenty-four permutations of the numbers 1, 2, 3, 4 set forth in Table I.

In an alternative embodiment of the present invention shown in FIG. 2, cube 60 is modified so that the corners of the different faces which meet to form a vertex do not have the same number Rather, the same three numbers are found on diametrically opposite vertices arranged such that the numbers on each of the three pairs of parallel sides that meet at these vertices are pair-wise the same. Thus, there are two vertices 77, 78 at which the corners are numbered 1,2,4 and these vertices are diametrically opposite each other with the corners numbered 1 on parallel faces 62, 65, the corners numbered 2 on parallel faces 61, 64 and the corners numbered 4, on parallel faces 63, 66. Similarly, there are two vertices 72, 75 at which the corners are all numbered 1,2,3 and these vertices are opposite each other, etc. As will also be apparent from FIG. 2, in cube 60 the same number is found at either end of any edge on opposite sides of the edge. For example, the number 2 is found in vertices 75 and 78 on opposite sides of the edge joining these vertices.

With either cube 20 or cube 60, the cube may be rotated about three orthogonal axes 81, 82, 83 running through the centers of its three major faces. As a result of such rotations, any of the six faces of the cube can be rotated about the two axes that do not pass through the that face so that it is moved into the position of any other face of the cube. Likewise, a face can be rotated about the axis through the face so that any one of its four corners is in a specified orientation such as the upper right hand corner of the face in the position of corner 1 of faces 21 and 61. This makes it possible to specify a set of rotations of the cube that will move any one of the twenty-four numbers of Table I to a specified face and orientation on the cube.

A specific application of the present invention is a baseball game utilizing either cube 20 or cube 60. During each half of an inning, one player, who may be thought of as the pitcher or the team in the field, chooses a cube face which bears a specific sequence and orientation. The player then rolls the cube, so that a new sequence appears on a specified face (e.g., the top face) of the cube when it lands. The object of the game is for the second player who may be called the batter, to start with the sequence that appears on the specified face of the cube when rolled and rotate the cube to the sequence that was chosen by the pitcher. If this is accomplished in 3 moves, for example, the player has achieved a single; if this is accomplished in 2 moves, the player has achieved a double; if the player achieves this in 1 move, it equals a home run; and if this is accomplished in 4 moves, this equals a sacrifice fly (or walk, if no man is on base). If the player cannot match the sequences in four moves, then the player is out. Play continues for three outs and then the players switch roles. Play continues for nine innings and the winner is the player with the most runs.

Different strategies can be used by the second player to rotate the cube so as to match the sequence specified by the first player If trial and error is used, it is likely to take several rotations before the second player finally stumbles onto the solution; and the scoring procedure set forth above should lead to a good game between two players both using a trial and error approach.

However, if a player analyzes the situation carefully he will realize that a match can always be obtained in three moves. Specifically, regardless of what sequence is specified by the first player and what sequence appears on the face of the cube, only two rotations of the cube are needed to rotate any face of the cube into the proper facing position for a match; and once the face is properly located, no more than two rotations of that face about the axis through that face are needed to move the face into the orientation that matches the specified sequence. Thus, any match can be achieved in a minimum of four moves.

Moreover, careful consideration of the situation described in the paragraph immediately above will also reveal that there is only one situation where four moves are used, namely, the situation where the cube must be rotated twice to move the face of the cube into the proper facing position from a position on the opposite side of the cube. However, in this situation, there are two ways to rotate the cube into the proper facing position, each using a different one of the two rotational axes which do not go through the facing position. Each of these ways of rotating the cube moves the cube into the facing position, with a different orientation. As a result only one rotation of the cube in the facing position is needed to move the cube into the orientation that matches the specified sequence.

For example, if the sequence 1,2,3,4 is specified by the first player and if cube 20 is rolled to give 3,2,1,4, then the cube can be brought into the proper facing position by two 90 degree rotations about axis 82 to put the sequence 4,1,2,3 in the facing position and the cube can be moved into the proper orientation by one 90 degree rotation about axis 81, for a total of three moves. A rotation in the opposite direction about axis 81 will put the sequence 3,4,1,2 in the matching orientation. Finally, if the sequence 2,3,4,1 is to be matched, this can be obtained in two moves by two 90 degree rotations about axis 83 to put the sequence 2,3,4,1 into the facing position.

Once the players realize that a match can always be achieved in three moves, the scoring rules should be tightened considerably. In this situation for example, a home run might be awarded only if the sequence specified by the first player is matched by the roll of the cube. A match with a single rotation illustratively would be scored as a double and a match with two rotations would be scored as a single. A match that took three or more rotations would be an out. Rather than use four alphanumeric symbols as the symbols in the four corners of each face, four arbitrary symbols can be used to enhance the difficulty of remembering the order among the symbols on the six faces. Alternatively, certain rotations or sequences of rotations could be prohibited. Time limits, for example, thirty seconds or one minute, might be used to force the second player to react quickly. Failure to respond in the time allotted could be counted as a strike or an out depending on the skill level of the player. Moreover, by varying the rules depending on the player skill, different levels of proficiency can be accommodated in the same game.

The game can also be played on a computer either by using the computer to simulate the play that would occur using cubes 20 or 60 or by using the computer to simulate other matching games that can be devised using permutations.

To consider the computer implementation of cubes 20, 60, it is necessary to have a precise nomenclature for the various manipulations that may be performed on a cube. First, we will read the numbers on a face commencing in the upper right hand corner and proceeding counterclockwise. Thus, each of the twenty-four different four digit numbers uniquely specifies a face of the cube and which digit is in the upper right hand corner. Next we will describe a move as a 90 degree rotation either clockwise or counterclockwise about one of axes 81, 82, 83. As a result there are six moves which we will call A,B,C,D,E,F. With reference to the directional arrows shown in FIG. 1, we also call a 90 degree clockwise rotation about axis 81 a "rotation" which is represented by R; a 90 degree clockwise rotation about axis 82 a "flip" which is represented by F; and a 90 degree counterclockwise rotation about axis 83 a "turn" which is represented by T. Rotations of 180 degrees or 270 degrees are represented by the numbers 2 or 3, respectively, in front of the symbol identifying the axis of rotation. For example, 2T represents a turn of 180 degrees, and F3R represents a flip of 90 degrees and a rotation of 270 degrees.

These operations can be defined as set forth in Table II which indicates what numbers will take the place of the numbers 1,2,3,4 on the face 21 of cube 20 after the operations of rotation, flip and turn about axes 81, 82, 83, respectively.

TABLE II

| | | Operation |
|---|---|---|
| Rotation R about axis 81 | | |
| Clockwise | 2341 | A |
| Counterclockwise | 4123 | B |
| Rotation F about axis 82 | | |
| Clockwise | 2413 | C |
| Counterclockwise | 3142 | D |
| Rotation T about axis 83 | | |
| Clockwise | 4312 | E |
| Counterclockwise | 3421 | F |

In this case the computer specifies a first sequence of four digits and randomly generates a second sequence. The player then issues selected commands to the computer to perform operations A,B,C,D,E and F to transform the second sequence as it would be transformed if the rotation, flip or turn specified by the selected command(s) had been performed on the actual cube. The computer displays these sequences as they are transformed and scores the player's effort.

Once again a baseball-like game can be played by two players who alternate turns with scoring done by the computer in the form of baseball runs, hits and out and with play alternating after every three outs until nine innings are completed.

While the computer can be used to simulate the cubes of FIGS. 1 and 2, it can also be used to define transformations between number sequences that are not those found on cubes 20 or 60.

The difficulty of play can also be controlled by the computer. For example, it can impose time limits on player response and can vary such time limits by skill level. It can also prohibit the use of certain transformations and/or vary the use of such transformations by skill level.

If desired, the computer can also implement more complicated games involving permutations of larger numbers of symbols. For example, the number of permutations of five different symbols is $5! = 120$ and there are 24 rotationally distinct orderings of five symbols. Very complicated games can be developed by defining transformations among these symbols.

As will be apparent to those skilled in the art, numerous variations may be made in the above-described games which are within the spirit and scope of the invention. For example, situation cards may be provided as part of the game with one card being drawn by the batter every time the cube is rolled. These cards might indicate the location of any base runners or might alter the score to be awarded for a solution in a specified number of moves or might require the player to rotate the cube in a specified direction regardless of the impact of the rotation on the optimum solution.

What is claimed is:

1. A game comprising the steps of:

providing a cube having six sides, each side having four corners, each of which corners is identified by a different one of four symbols, the same four symbols being used to identify the corners of each of the six sides but in different orders, said cube having eight vertices each formed by three corners of three different sides, the symbols being ordered so that at each vertex the same symbol is found at each of the three corners that form that vertex;

selecting a sequence of the four symbols;

rolling the cube; and rotating the cube about at least one of its axes to cause the sequence of symbols on the cube to match the selected sequence of symbols.

2. The game of claim 1 further comprising the step of awarding a score based on the number of rotations needed to match the sequence of symbols on the cube to the selected sequence of symbols.

3. The game of claim 2 further comprising the step of alternating play between at least two players each of whom attempts to match a sequence on the cube to a selected sequence of symbols to attain a score.

4. The game of claim 3 further comprising the steps of accumulating a score for each player over a plurality of attempts to match the sequence of symbols on the cube to the selected sequence of symbols.

5. The game of claim 4 wherein scores are awarded in terms of baseball runs, hits and outs, play alternates between two players after every three outs and scores are accumulated in terms of runs.

6. A game comprising the steps of:

providing a cube having six sides, each side having four corners, each of which corners is identified by a different one of four symbols, the same four symbols being used to identify the corners of each of the six sides but in different orders, said cube having eight vertices each formed by three corners of three different sides, the symbols being ordered so that at each vertex the symbols in the corners of the three sides that form that vertex are different;

selecting a sequence of the four symbols;

rolling the cube; and rotating the cube about at least one of its axes to cause the sequence of symbols on the cube to match the selected sequence of symbols.

7. The game of claim 6 further comprising the step of awarding a score based on the number of rotations needed to match the sequence of symbols on the cube to the selected sequence of symbols.

8. The game of claim 7 further comprising the step of alternating play between at least two players each of whom attempts to match a sequence on the cube to a selected sequence of symbols to attain a score.

9. The game of claim 8 further comprising the steps of accumulating a score for each player over a plurality of attempts to match the sequence of symbols on the cube to the selected sequence of symbols.

10. The game of claim 9 wherein scores are awarded in terms of baseball runs, hits and outs, play alternates between two players after every three outs and scores are accumulated in terms of runs.

11. A game comprising the steps of:

defining at least a first operation which rotates the elements of each rotationally distinct set of a set of permutations of n elements and at least a second operation which transforms each of the rotationally distinct sets of the set of permutations into at least one of the other rotationally distinct sets of the set of permutations, forming a first permutation of said n elements forming a second permutation of said n elements, transforming the second permutation into the first permutation by performing at least one of said first and second operations on the elements of said second permutation.

12. The game of claim 11 further comprising the step of awarding a score based on the number of operations needed to transform the second permutation into the first permutation.

13. The game of claim 12 further comprising the step of alternating play between at least two players each of whom attempts to transform a second permutation into a first permutation.

14. The game of claim 13 further comprising the steps of accumulating a score for each player over a plurality of attempts to transform a second permutation into a first permutation.

15. The game of claim 14 wherein scores are awarded in terms of baseball runs, hits and outs, play alternates between two players after every three outs and scores are accumulated in terms of runs.

16. The game of claim 11 wherein n is four.

17. A game piece comprising a paralleleped having six sides, each side having four corners, each of said corners being identified by a different one of four symbols, the same four symbols being used to identify the corners of each of the six sides but in different orders, said cube having eight vertices, each defined by one corner of each of three sides, each corner in a vertex being identified by a different symbol and the same symbol in adjacent vertices identifying the corners on opposite sides of an edge connecting the adjacent vertices.

* * * * *